United States Patent [19]

Webster

[11] Patent Number: 4,954,725

[45] Date of Patent: Sep. 4, 1990

[54] BI-PLANAR SWITCH DEVICE WITH LEVEL INDICATOR

[75] Inventor: Todd Webster, South Bend, Ind.

[73] Assignee: Power Components of Midwest, Inc., Mishawaka, Ind.

[21] Appl. No.: 326,565

[22] Filed: Mar. 20, 1989

[51] Int. Cl.[5] ..... H01H 35/02; H01H 35/14

[52] U.S. Cl. ..... 307/10.1; 200/61.52; 200/215; 200/187

[58] Field of Search ..... 307/9.1, 10.1, 112, 307/116; 200/61.47, 61.52, 183, 187, 188, 215, 217, 220, 235, 236; 340/967, 974–976, 429, 440, 689; 180/282–285

[56] References Cited

U.S. PATENT DOCUMENTS

| | | | |
|---|---|---|---|
| 2,070,683 | 2/1937 | Price | 200/215 |
| 2,757,749 | 8/1956 | Cooper et al. | 200/61.52 |
| 3,259,202 | 7/1966 | Griffeth | 200/61.52 |
| 3,581,038 | 5/1971 | Brian | 200/61.47 |
| 3,657,695 | 4/1972 | Birmingham | 340/440 X |
| 3,946,359 | 3/1976 | Henderson | 200/61.47 X |
| 3,999,178 | 12/1976 | Hamilton | 340/282 |

OTHER PUBLICATIONS

Cuming, William R., "Plastic-Enbedded Circuits", *Electronics*, Jun. 1950, pp. 66–69.

*Primary Examiner*—A. D. Pellinen
*Assistant Examiner*—David Osborn
*Attorney, Agent, or Firm*—Todd A. Dawson

[57] ABSTRACT

A bi-planar switch device having a plurality of spaced switches carried by a base. A level indicating device carried by the base indicates the orientation of the base relative to horizontal. Each switch is carried by a seat carried by the base. Each seat may be angularly displaced relative to the base to set its corresponding switch at a preselected angle relative to the base, each switch may be shifted within its seat ride upon the seat shoulder to adjust its preselected angle. A circuit is connected to the switches to eliminate the effects of switch bounce.

1 Claim, 1 Drawing Sheet

BI-PLANAR SWITCH DEVICE WITH LEVEL INDICATOR

FIELD OF THE INVENTION

This device relates to a multi-plane switch device which is activated in multiple axes and will have application to a bi-planar switch device having switches which may be angularly displaced relative to the base and are connected to a debouncing circuit.

It is common in the recreational vehicle industry to automatically level a vehicle relative to horizontal by a plurality of extensible jacks which are activated by a control device responsive to a plurality of switches which sense the horizontal position of the vehicle. Such a leveling system is illustrated in U.S. Pat. No. 4,597,584 issued to Hanser on Jul. 1, 1986. Hanser illustrates a switch device in which a plurality of mercury switches are carried by a base and have their output connected to a control device which interprets the switch input and activates a hydraulic cylinder accordingly so as to level the vehicle. The switch device of Hanser is arranged such that when the vehicle is level with respect to the horizontal the mercury switches are all open.

BACKGROUND OF THE INVENTION

A problem exists however in that during operation of the lifting deviceS it is common that the switches, typically mercury, are closed and opened momentarily when the vehicle is jostled during leveling. Such momentary closures commonly referred to as switch bounce will create false signals to the control device which may mistakenly interpret such signals as commands to activate a lift cylinder.

SUMMARY OF THE INVENTION

The switch device of this invention eliminates this problem by providing a debouncing circuit connected to the switches to eliminate unwanted switch closures caused by jostling of the vehicle.

Another application of this invention is in use with a portable aerial lift or scissors lift. Current OSHA regulations specify a maximum tilt that such scissor lifts may be operated. This invention may be connected to a device such that when operation of the scissor lift is attempted at an angle exceeding the OSHA maximum tilt the lift motor would be disabled thus preventing extension of the scissor lift at unsafe angles.

Further, this invention includes a plurality of indentations or switch seats in the base for supporting each of the mercury switches. Each seat has an end shoulder wherein the swtiches may be longitudinally shifted within the seats to ride upon the shoulder thereby increasing their carrying angle to compensate for imperfections or manufacturing tolerances in the switches or seats. The seats may be formed at indepedent angles out of the horizontal with respect to the base to preset the switches at predetermined activation angles.

Accordingly, it is an object of this invention to provide for a novel bi-planar switch device.

Another object of this invention is to provide for a switch device having a debouncing circuit attached thereto for preventing false triggering of a connected lift device.

Another object of this invention is to provide for a bi-planar switch device wherein each switch may be preset at an angle indepedent from the remaining switches.

Another object of this invention is to provide for a bi-planar switch device wherein the switches may be shifted to slightly increase their angle relative to their seat.

Other objects of this invention will become apparent upon a reading of the following description taken with the accompanying drawings.

DESCRIPTION OF THE PREFERRED EMBODIMENT

The preferred embodiment herein described is not intended to be exhaustive or to limit the application to the precise form disclosed. It is chosen and described to illustrate the invention so that others skilled in the art might utilize its teachings.

Figure 1:
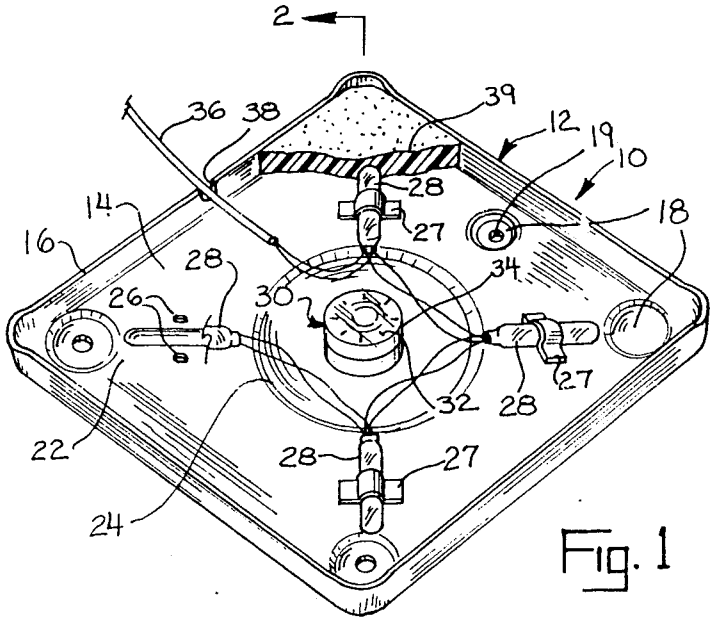
FIG. 1 is a perspective view of the switch device of this invention with portions cut away for illustrative purposes.

Referring now to FIG. 1, bi-planar switch device 10 includes a dish-shaped base 12 having a wall 14 and sides 16. A plurality of indentations 18 are formed in wall 14 which function as standoffs for base 12 if the base is mounted on top of a supporting surface (not shown). Each indentation 18 may have an opening 19 therethrough to provide access for a mounting fastener (not shown). A plurality of equally spaced seats 22 are formed in wall 14 about a central indentation 24. Each seat 22 includes a shoulder 23 formed at its outward end relative to indentation 24. Openings 26 are formed through wall 14 on opposite sides of seats 22 to accommodate a retaining strap 27.

Bi-planar switch device 10 further includes a plurality of angle sensitive switches 28 positioned within seats 22 of base 12 and held therein by straps 27. In the preferred embodiment, switches 28 are typical mercury type switches utilizing a bead of mercury which is shiftable responsive to the angular position of its glass envelope to either electrically connect or disconnect the internally disposed contacts. Such memory switches are common in industry and are not considered a novel point of this invention.

A level indicating device 30 is positioned within central indentation 24 upon wall 14. As is common in the industry, level indicating device 30 includes a single air bubble freely floating in a liquid and indicia 32 imprinted on top of its enclosure 34. When level indicating device 30 is positioned level with respect to horizontal the air bubble is positioned in the center of indicia 32. Such level indicator device is commonly known.

Figure 3:
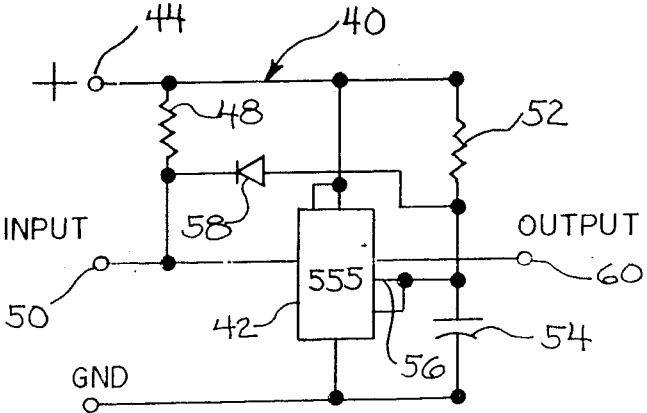
FIG. 3 is a schematical representation of the circuitry connected to the switches for debouncing purposes.
Figure 2:
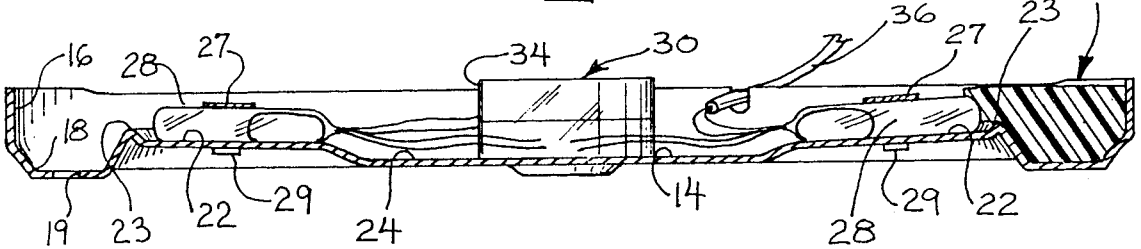
FIG. 2 is a cross-sectional view of the switch device of this invention taken along lines 2—2 of FIG. 1.

A common debouncing circuit 40 as illustrated in FIG. 3 is provided for connection to switches 28. Circuit 40 includes as a major component a common 555 timer 42 connected between a positive voltage supply lead 444 and ground lead 46. A pull up resistor 48 is connected between positive voltage supply lead 44 and the input lead 50 of timer 42. An RC circuit consisting of resistor 52 and capacitor 54 is connected between positive supply lead 44 and ground lead 46 with their junction connected to RC lead 56 of timer 42. A diode 58 is connected between the junction of capacitor 54 resistor 52 and the input lead 50. Timer 42 includes an output lead 60 which is adapted for connection to a device such as a microprocessor or diabling circuit dependent upon the use and shown in block form only in FIG. 4.

Figure 4:
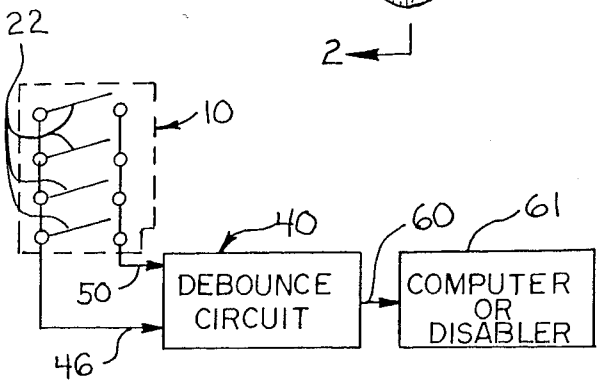
FIG. 4 is a block diagram of the switch device associated with a computer or disabler circuit.

In use, a switch 28 is placed in each indentation 22 and may be connected in either series or parallel configuration by wiring harness 36 which exits through a notch 38 formed in one side wall 16. FIGS. 1 and 4 illustrate the switches connected in a parallel configuration. Switches 28 are retained within seats 22 by straps 27 which has nibs 29 snap-fitted within opening 26 in a common manner. Switches 28 may be longitudinally shifted on seats 22 prior to attaching straps 27 to ride upon shoulder 23 thereby increasing the activation angle at which the switch is supported to compensate for switch tolerances or manufacturing variations in the switch or seat. With level indicating device 30 placed in the center of depression 24, base 12 is filled with an epoxy resin 39 to cover and protect the mercury switches 28. Epoxy resin 39 does not cover the top of level indicating device 30 to allow viewing of the indicator.

So assembled, the external leads from switches 28 are connected via wiring harness 36 to the input lead 50 and ground lead 46 of debouncing circuit 40 of FIG. 3 which has its output lead 60 connected to a microprocessor, illumination device or interrupt device 61 depending upon the particular use of bi-planar switch device 10. (See FIG. 4)

When connected to a vehicle and voltage is supplied to debouncing circuit 40 a logical high voltage level appears at input lead 50 due to pull-up resistor 48 interconnecting the input lead with the positive voltage supply lead 44. Since switches 28 are connected across input lead 50 ground lead 46 by harness 36, if a switch 28 closes, input lead 50 is connected to ground which causes a logical low voltage level at the input lead. The logical voltage triggers timer 42 which changes its output from a high to low logical voltage level for a predetermined period of time as determined by resistor 52 and capacitor 54. Until the timer returns its output to its original voltage level a second or third switch closure will not be recognized. Therefore, with the predetermined period of time set to a relatively short period of time, triggering caused by switch bounce will be eliminated.

If desired, the angular displacement of seats 22 relative to wall 14 of base 12 may be varied when forming base 12 to preset its corresponding switch 28 at a selected attitude. Therefore, each seat 22 may be formed at an angle independent from one another to thereby predetermine the angle at which each switch device is carried. Such arrangement is specifically useful on items such as riding lawn mower as a rollover warning device. Since the tendency of rollover on a common riding lawn mower is greater on a side to side direction than on an end to end direction, a switch device must be able to activate at a variety of angles. Seats 22 may be formed so as to preset two switches 28 indicating the side to side dimension of a lawn mower at a relative low angle and the switches indicating end to end dimension of the lawn mower at a relative high angle.

It should be understood that the above description is not to be limited by the above description but may be modified with the scope of the appended claims.

I claim:

1. A switch device adapted for connection to a vehicle, said switch device for indicating the orientation of said vehicle relative to horizontal and comprising a base, a plurality of switches, said base having a plurality of seating means for supporting said plurality of switches, each switch being seated in a said seating means and having an open position and a closed position dependent upon the orientation of the switch relative to the horizontal, each switch supported in said seating means at a predetermined angle relative to said base, said angle being indicative of an at rest position of said vehicle relative to the horizontal when the switch device is connected to said vehicle, each of said switches independently shift between its open and closed positions when said vehicle is positioned at an angle which exceeds the switches predetermined angle, wherein each seating means is an indentation formed in said base, each indentation being spaced from another indentation and includes an end shoulder constituting means for supportiong a portion of said switch whereby said predetermined angle of said switch is increased.

* * * * *